US005632314A

United States Patent [19]

Koppe et al.

[11] Patent Number: 5,632,314

[45] Date of Patent: May 27, 1997

[54] AUTOMATED DISPENSING APPARATUS

[75] Inventors: Klaus-Dieter Koppe; Michael Krapalis, both of Norderstedt, Germany

[73] Assignee: Fluid Management, Inc., Wheeling, Ill.

[21] Appl. No.: 670,838

[22] Filed: Jun. 28, 1996

Related U.S. Application Data

[63] Continuation of Ser. No. 403,252, Mar. 10, 1995, abandoned.

[51] Int. Cl.[6] ..... B65B 1/04; B65B 3/00

[52] U.S. Cl. ..... 141/104; 141/83; 137/636.4; 222/144.5; 222/486

[58] Field of Search ..... 141/83, 9, 104, 141/103; 137/636, 636.4, 636.2, 636.3; 222/144.5, 486; 128/200.19

[56] References Cited

U.S. PATENT DOCUMENTS

| | | | |
|---|---|---|---|
| 2,901,209 | 8/1959 | Bardy et al. | 249/15 |
| 3,066,830 | 12/1962 | Heiss et al. | 141/104 |
| 3,180,360 | 4/1965 | Pavlin | 137/625.5 |
| 3,759,422 | 9/1973 | Matheney | 222/144.5 |
| 5,129,551 | 7/1992 | Gott | 222/135 |
| 5,163,484 | 11/1992 | Howlett et al. | 141/103 |

FOREIGN PATENT DOCUMENTS

| | | | |
|---|---|---|---|
| 0003563A1 | 2/1979 | European Pat. Off. . | |
| 0283137A1 | 9/1988 | European Pat. Off. . | |
| 882423 | 6/1943 | France . | |
| 2839204B1 | 9/1978 | Germany | G01F 11/32 |
| 3201221A1 | 7/1983 | Germany | G05O 11/04 |
| WO88/06690 | 9/1988 | WIPO | F16K 1/44 |

OTHER PUBLICATIONS

Four page advertising brochure for Full Professional Automatic dispensing station FS 2001 (no date available).

One page advertisement for Fluid FV 1010 computer controlled, compact dispensing system (no date available).

*Primary Examiner*—Henry J. Recla
*Assistant Examiner*—Steven O. Douglas
*Attorney, Agent, or Firm*—Fitch, Even, Tabin & Flannery

[57] ABSTRACT

A dispenser for flowable materials includes a plurality of dispense valves arranged in two concentric circles. An actuator arm mounted for rotation about the center of the circles glides over the tops of the valves. A pair of channel-like passageways are formed in the arm, one for the valves arranged in the outer circle, the other for the valves arranged in the inner circle. The valves of the inner and outer circles are radially offset from one another, and accordingly a valve from only one of the two circles is engaged at any given time. The arm is mounted for lifting and lowering movements to accomplish a dispense operation.

23 Claims, 11 Drawing Sheets

AUTOMATED DISPENSING APPARATUS

This application is a continuation of application Ser. No. 403,252 filed Mar. 10, 1995, now abandoned.

BACKGROUND OF THE INVENTION

1. Field of the Invention

The invention pertains to apparatus for dispensing flowable materials, and more particularly to such apparatus which is suitable for automated operations.

2. Description of the Related Art

With increasing emphasis on inventory reduction and innovative manufacturing management techniques, such as "just in time," and other techniques, custom blending of recipes is becoming increasingly important in a variety of different industries. For example, food flavorings, cosmetics, paints and inks are being custom blended to produce formulations in made-to-order quantities on demand.

There is an increasing emphasis today on compact automated dispensing apparatus. Problems are encountered, however, when attempts are made to compact high throughput automated dispensing equipment used in a high volume production environment. Consideration must be given not only to the larger size of the dispense valves required, but also to the routing of conduits which are significantly increased in cross-sectional size so as to accommodate the higher throughput rates of the system. These and other related factors make it difficult to provide dispense assemblies having the capability of dispensing a plurality of formulation ingredients. For example, paint coatings require a plurality of different color tinting materials. Tinting systems having as many as 8 to 16 different colors are commonly employed in the paint industry. Dispense equipment for such applications meters the requisite amount of different tint materials, depositing them into a common container, which usually contains a base paint mixture. Thus, a plurality of different dispense valves, even though of large throughput capacity, must be closely positioned so as to accommodate a standard size container.

SUMMARY OF THE INVENTION

It is an object of the present invention to provide dispensing apparatus for formulating recipes using a plurality of different ingredients.

Another object according to the principles of the present invention is to provide a dispense head of the above-described type which allows relatively high throughput rates, but which is compact in size so as to be able to accommodate standard size containers.

Another object according to the principles of the present invention is to provide dispense apparatus of the above-described type which is flexible in operation so as to accommodate different conveyor configurations transporting materials to and from the dispenser apparatus.

Yet another object of the present invention is to provide dispensing apparatus of the above-described type which can readily accommodate different types of dispense valves.

A further object according to the principles of the present invention is to provide dispense apparatus of the above-described type which can be assembled from a minimum number of inexpensive parts, with minimal labor investment.

These and other objects according to the principles of the present invention are provided in dispensing apparatus, comprising:

a plurality of valves arranged along first and second nested curved lines, the valves having housings with upper ends and coupling means at the upper ends for releasably engaging an actuator arm, the coupling means operating the valves between open and closed positions when moved with respect to the valve housing;

an actuator arm releasably engageable with the valve's coupling means; and mounting means for mounting the actuator arm for movement across the valves, passing the arm into and out of engagement with the valves it crosses, and said mounting means mounting the actuator arm for movement toward and away from the valves to open and close the valves so as to dispense material from the valves.

Other objects are provided in dispensing system for dispensing a plurality of different materials, comprising:

a dispense cabinet;

a plurality of storage tanks containing at least some of the materials to be dispensed;

a plurality of valves arranged within the cabinet along first and second nested curved lines, the valves having housings with upper ends and coupling means at the upper ends for releasably engaging an actuator arm, the coupling means operating the valves between open and closed positions when moved with respect to the valve housing;

conduit means coupling the tanks to the valves;

plurality of pumps for pumping the materials to the valves;

the cabinet including container supporting means for supporting a container underneath the valves, to receive material dispensed from the valves;

an actuator arm releasably engageable with the valve's coupling means; and mounting means for mounting the actuator arm for movement across the valves, passing the arm into and out of engagement with the valves it crosses, and said mounting means mounting the actuator arm for movement toward and away from the valves to open and close the valves so as to dispense material from the valves.

DETAILED DESCRIPTION OF THE PREFERRED EMBODIMENTS

Figure 2:
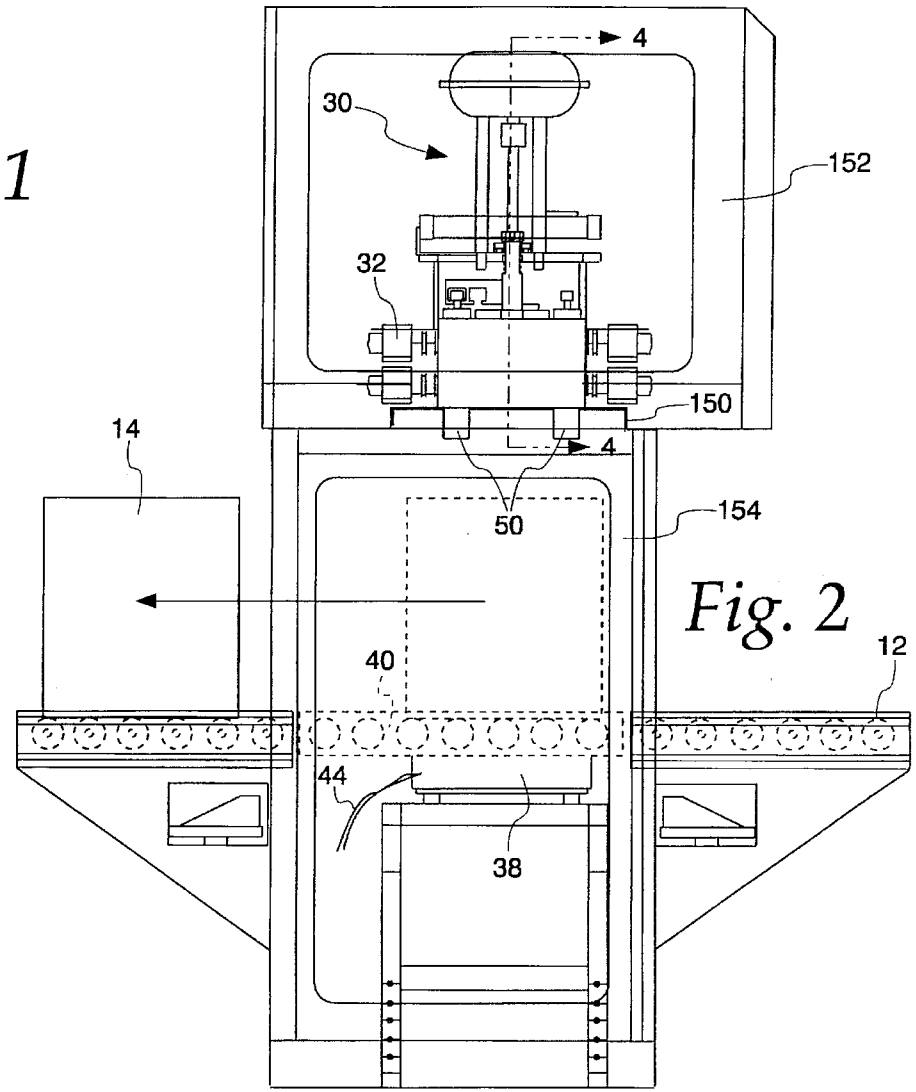
FIG. 2 is a front elevational view thereof.
Figure 1:
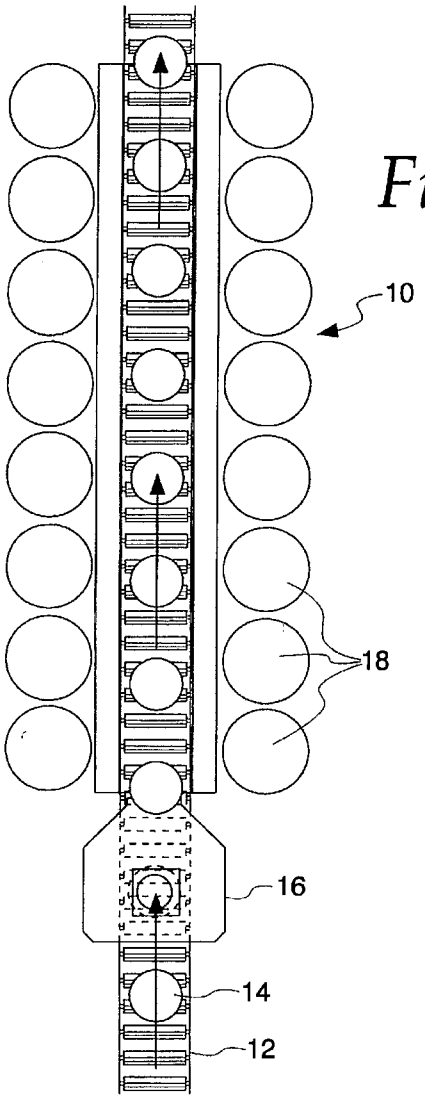
FIG. 1 is a top plan view of dispense apparatus according to principles of the present invention.
Figure 3:
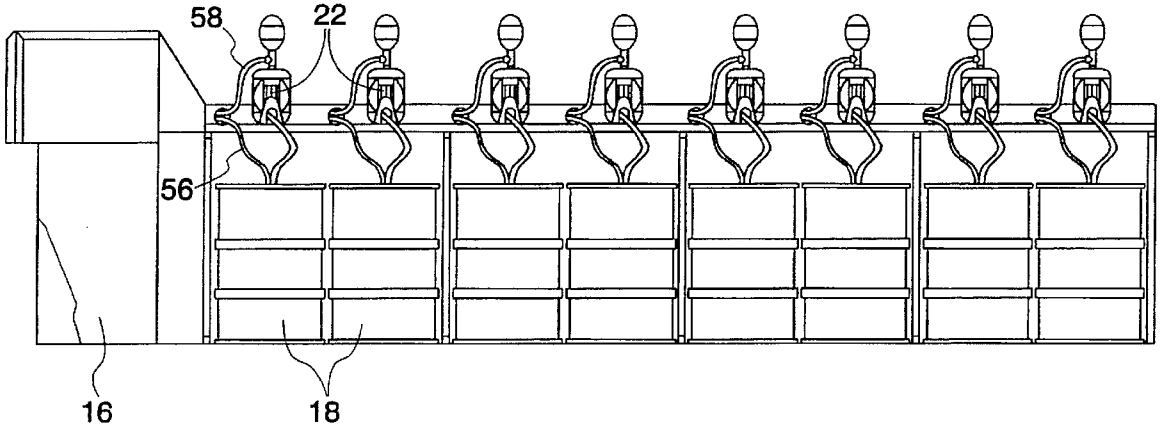
FIG. 3 is a side elevational view thereof.
Figure 9:
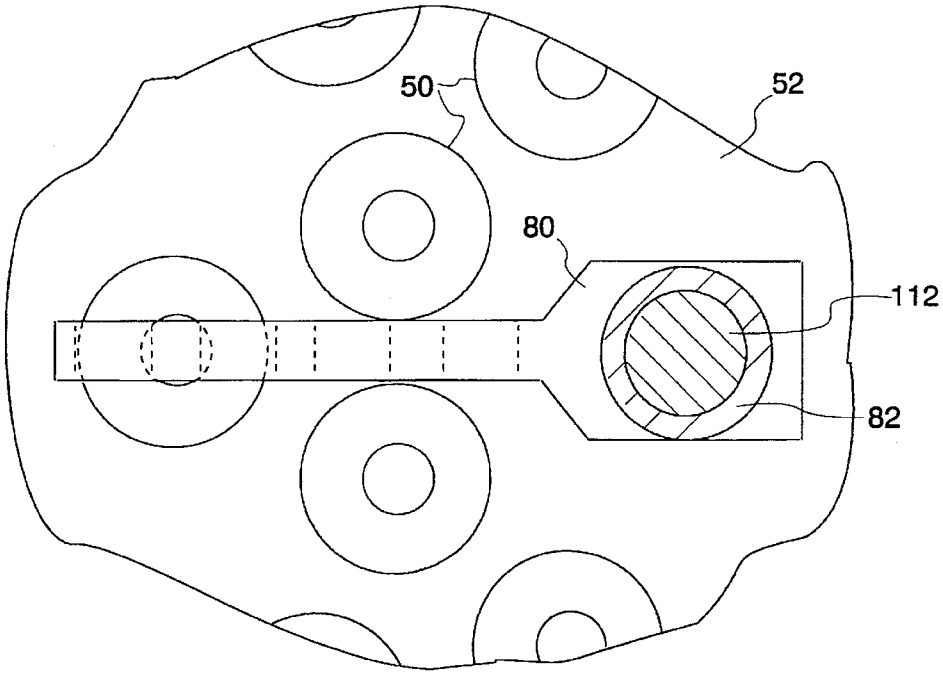
FIG. 9 is a fragmentary cross-sectional view showing a portion of FIG. 8 on an enlarged scale.

Referring now to the drawings, and initially to FIG. 1, a dispenser system according to principles of the present invention is generally indicated at 10. A conveyor 12 transports containers 14 through a dispense station 16. A plurality of tanks 18 feed material to be dispensed to station 16. FIG. 3 shows a series of pumps 22 delivering material from tanks 18 to dispense station 16. As shown in FIG. 2, dispense valving apparatus generally initiated at 30 includes a plurality of inlet conduits 56 and outlet conduits 58, coupled to tanks 18. The dispense apparatus 30 deposits quantities of material from tanks 18 into a container 14 placed below the dispense apparatus. Dispense station 16 includes a weigh scale 38 which supports a movable section of conveyor, designated by numeral 40. Scale 38 is coupled to an electronic control device 100 (see FIG. 4) through conductors 44. Signals from scale 38 are used to control the dispensing of material into container 14, to assure metering accuracy.

Figure 4:
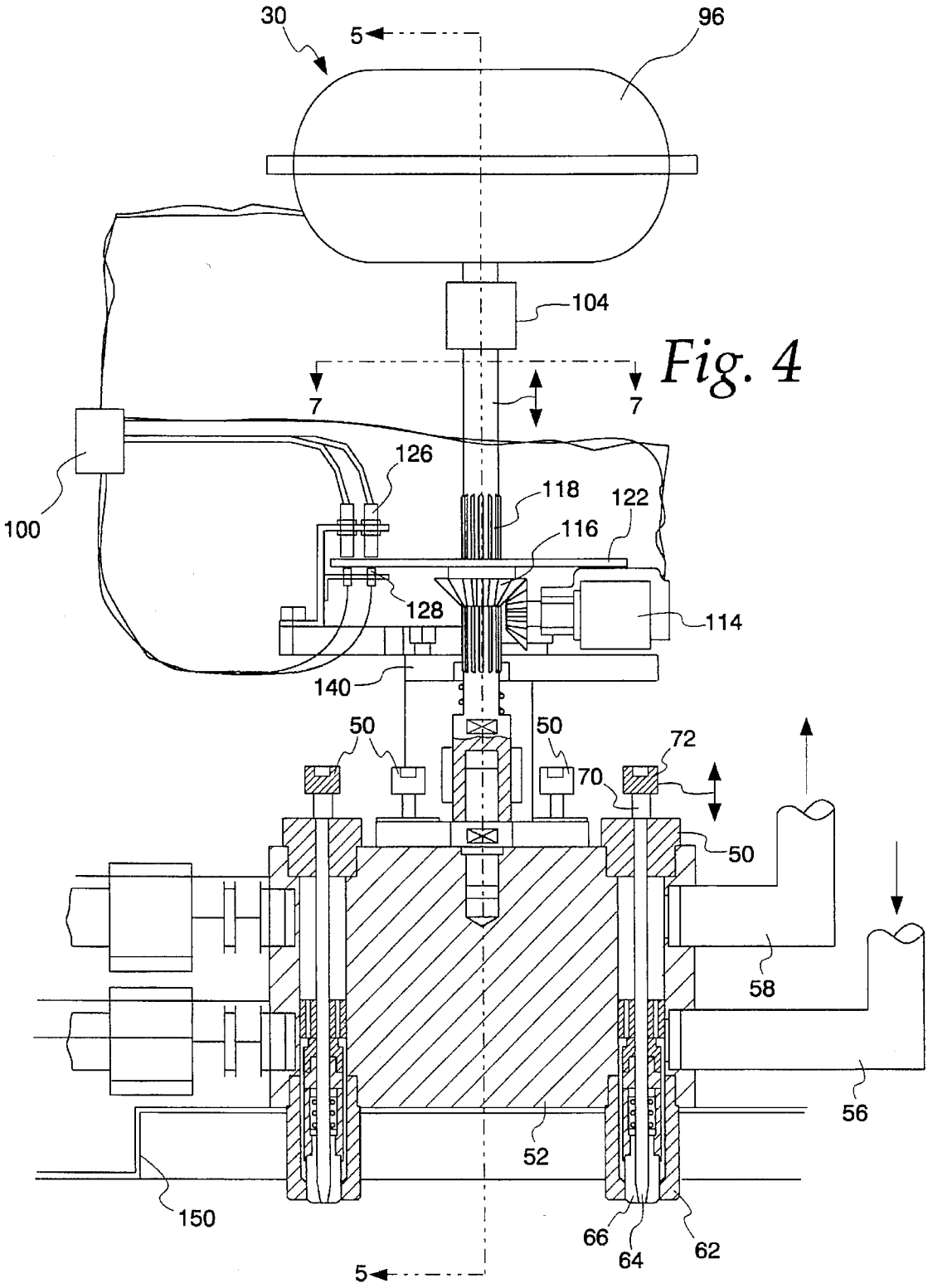
FIG. 4 is a view shown partly in cross section, taken along the line 4—4 of FIG. 2.
Figure 5:
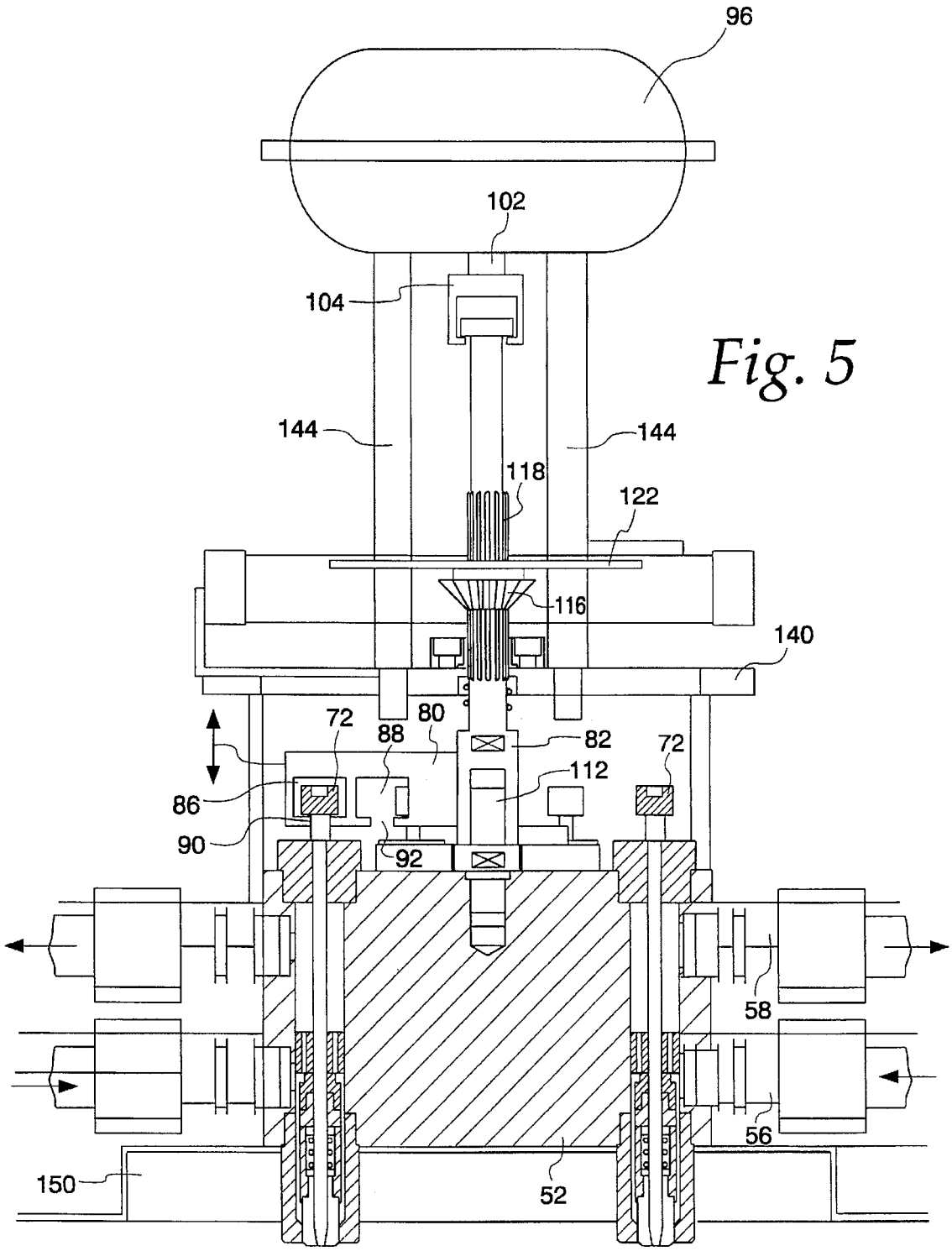
FIG. 5 is a view shown partly in cross section, taken along the line 5—5 of FIG. 4.

Turning now to FIG. 4, dispense apparatus 30 includes a plurality of valves 50 disposed within a mounting block 52. In the preferred embodiment, sixteen valves 50 are provided, and are arranged in mounting block 52 in multiple nested curved lines, preferably in the form of two concentric circles. The valves 50 are coupled to inlet and outlet conduits 56, 58, which are also mounted in block 52. Valves 50 have a bottom end 62 with a center valve 64 and an outer annular valve 66 concentrically arranged with respect to valve 64. The valves 64, 66 are open and closed by reciprocation of valve shaft 70 which has an enlarged end 72. Referring additionally to FIG. 5, a gripper arm 80 is mounted on drive shaft 82 for rotation about a vertical axis. As can be seen in FIG. 5, the gripper arm 80 includes keyhole-shaped sockets 86, 88, which are downwardly facing, and which have openings 90, 92 at their lower ends.

An actuator 96 is operated by vacuum under the control of a programmable logic controller or the like conventional control device 100. Actuator 96, which can be electrical or hydraulic as well as pneumatic, has a shaft 102 with a coupler 104 which engages the enlarged upper end of drive shaft 82. As actuator 96 reciprocates its output shaft in a vertical direction, drive shaft 82 is reciprocated a like amount, thereby raising and lowering the gripper arm 80. Actuator 96 is preferably of the stepless type, thus allowing flexibility in accommodating valves of different types. Drive shaft 82 is mounted for reciprocation on support shaft 112. A motor 114, operated under control of device 100, drives a bevel gear 116 which engages a splined portion 118 of drive shaft 82 so as to rotate gripper arm 80 about the vertical axis of shaft 82. Referring to FIG. 4, a timing disk 122 is mounted for rotation with drive shaft 82. Angular displacement of timing disk 122 is sensed by photoelectric sensors 126, 128, which are coupled to control device 100 to indicate the angular position of gripper arm 80.

Referring to FIG. 5, a support table 140 is supported from mounting block 52, and in turn supports the legs 144 of actuator 96 to allow actuator 96 to develop thrust in drive shaft 82 in reciprocal vertical directions. Motor 114 and photoelectric sensors 126, 128 are also supported from table 140. The actuator mechanism 130 is mounted on a support table 150 and is surrounded by an upper cabinet member 152, and supported from the floor by a lower cabinet member 154, as shown in FIG. 2.

Figure 8:
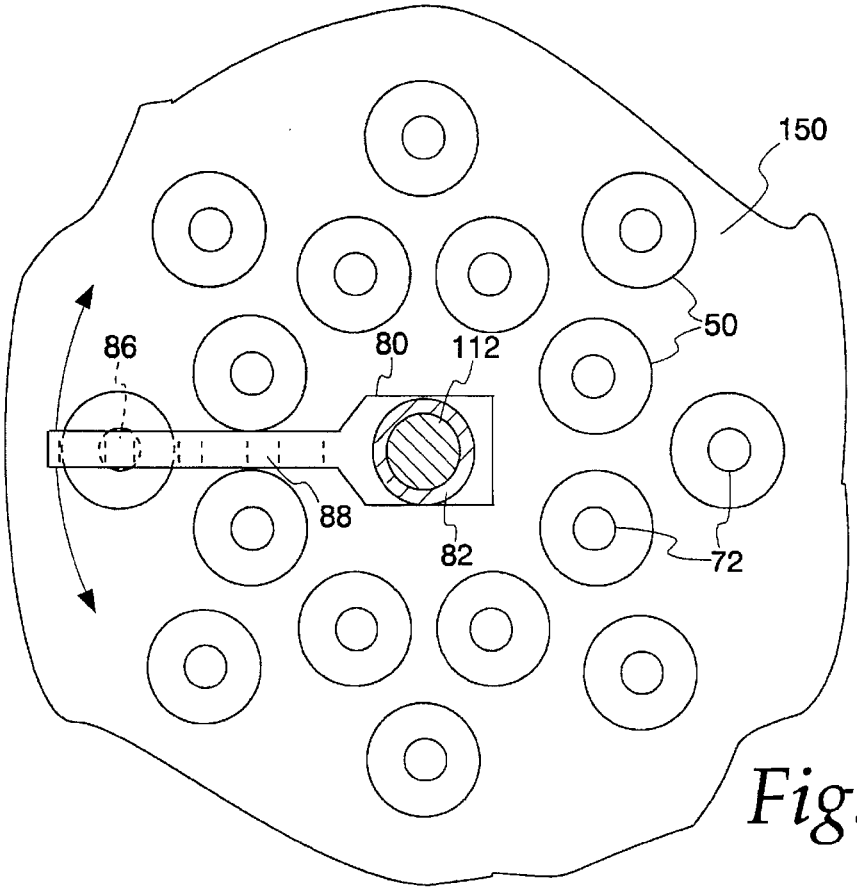
FIG. 8 is a cross-sectional view taken along the line 8—8 of FIG. 6.

Referring to FIG. 8, the valves 50 are preferably arranged in two concentric circles, with eight valves in each circle. The drive shaft 82 is positioned at the center of the circles, with gripper arm 80 being mounted for rotation about the center of the circles. With reference to FIGS. 5 and 8, gripper arm 80 is rotated in a horizontal plane as indicated in FIG. 5, with the valve ends 72 passing through the channels 86, 88 and with the actuator shafts of the valves passing through openings 90, 92. The valves in the outer circle pass through channel 86, whereas the valves of the inner circle pass through channel 88. As can be seen in FIG. 8, the valves of the inner circle are staggered (i.e., radially displaced) with respect to the valves of the outer circle. The valves 50, as can be seen in FIG. 8, are thereby arranged in a compact arrangement such that the distance between diametrically opposed valves of the outer circle is held to a minimum length needed to accommodate the inner circle valves as well as the actuating mechanism.

Figure 6:
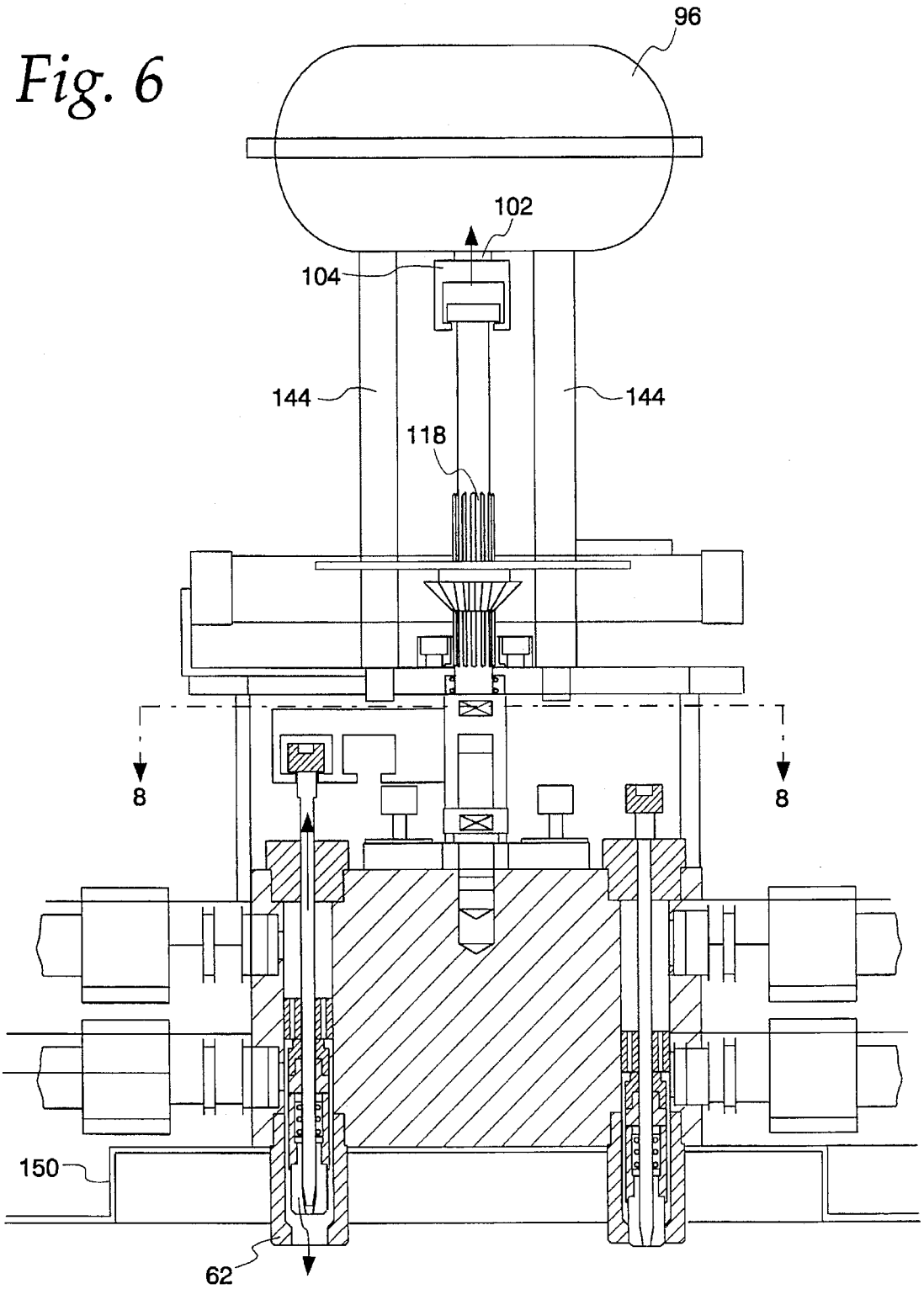
FIG. 6 is a view similar to that of FIG. 5, but showing the actuator arm in a raised position.
Figure 7:
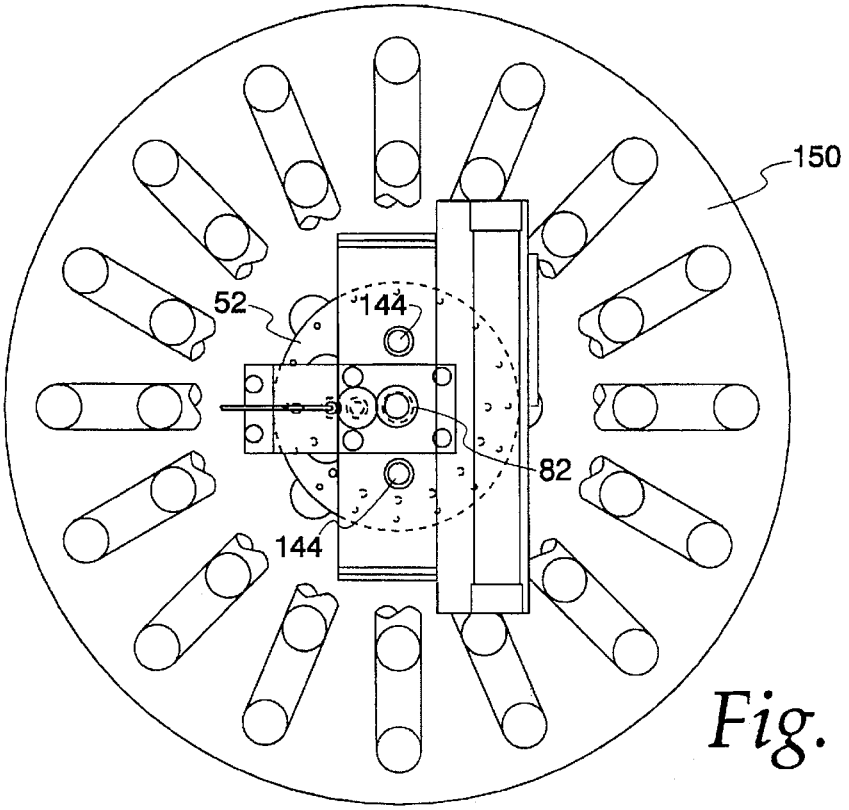
FIG. 7 is a cross-sectional view taken along the line 7—7 of FIG. 4.

As can be seen in FIG. 8, as gripper arm 80 travels in a direction of rotation, valves of the inner and outer circles alternately pass through the sockets of in the gripper arm. For example, in FIG. 8, the gripper arm 80 is positioned between valves of the inner circle so as to engage a valve of the outer circle. With reference to FIGS. 5 and 6, the gripper arm 80 is then raised by instructions to actuator 96, sent under control of device 100. As shown in FIGS. 5 and 6, the enlarged ends 72 of the valve shafts are held captive in the gripper arm sockets, and accordingly, as the gripper arm is raised, the valve shaft is also raised so as to operate the valve.

FIG. 5 shows the valve in a closed position, preparatory to a dispensing operation, with material being circulated through the valve. Circulation may be continuous, or may be instituted immediately prior to a dispensing cycle. FIG. 6 shows the valve shaft being raised, to move the valve elements to their open positions, and to block recirculation flow through the valve, diverting material through the dispense end 62 of the valve. As mentioned above, valves 50 include two valve elements, a smaller central valve element or needle valve 64 and a larger outer concentric valve 66. By controlling the amount that the gripper arm 80 is raised, the valve elements can be operated in different stages. Upon completing a dispensing operation, the gripper arm is lowered generally to the position shown in FIG. 5, being readied for rotation so as to engage the next valve called for in a formula.

Figure 10:
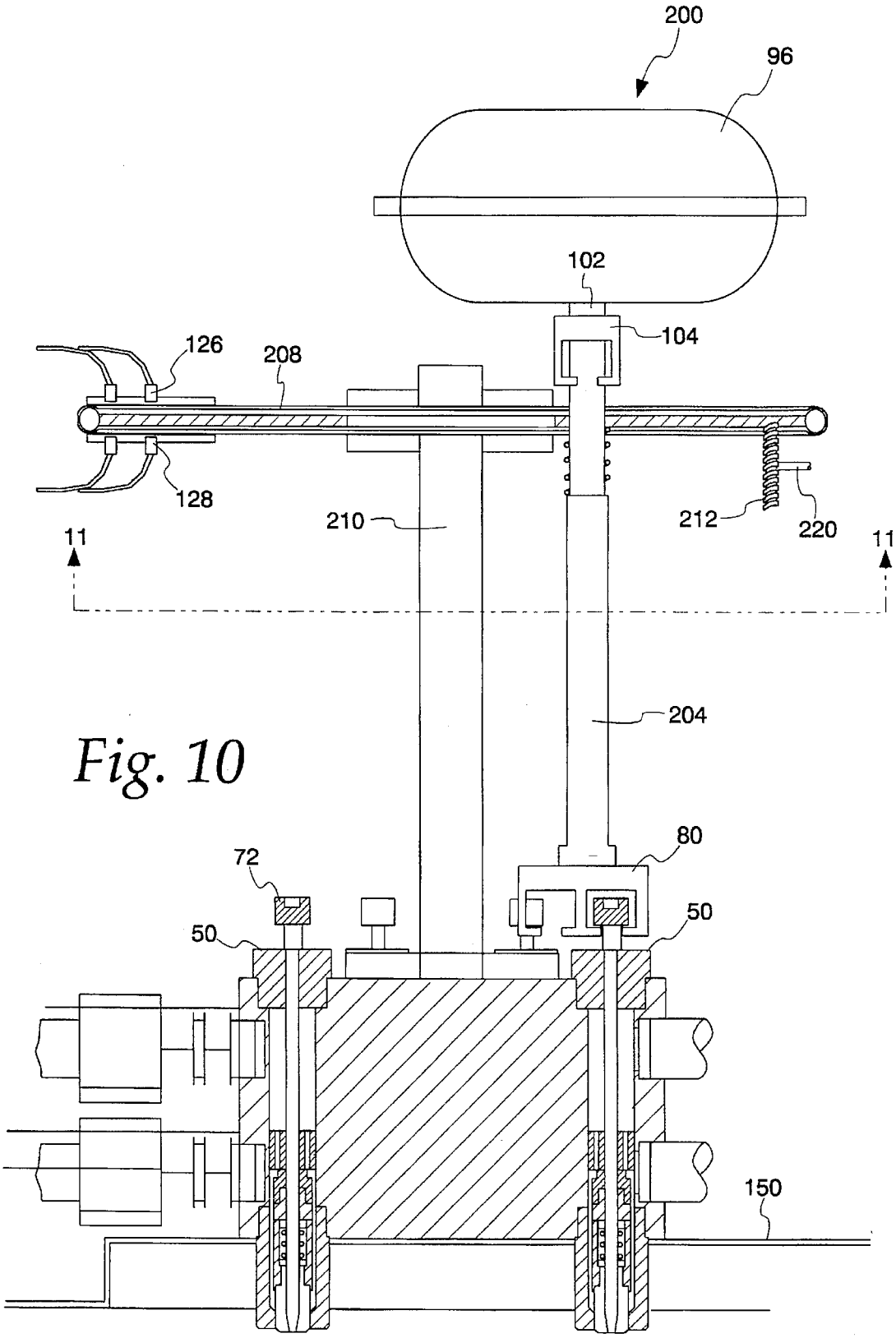
FIG. 10 is a cross-sectional view showing an alternative embodiment of a dispenser according to principles of the present invention.
Figure 11:
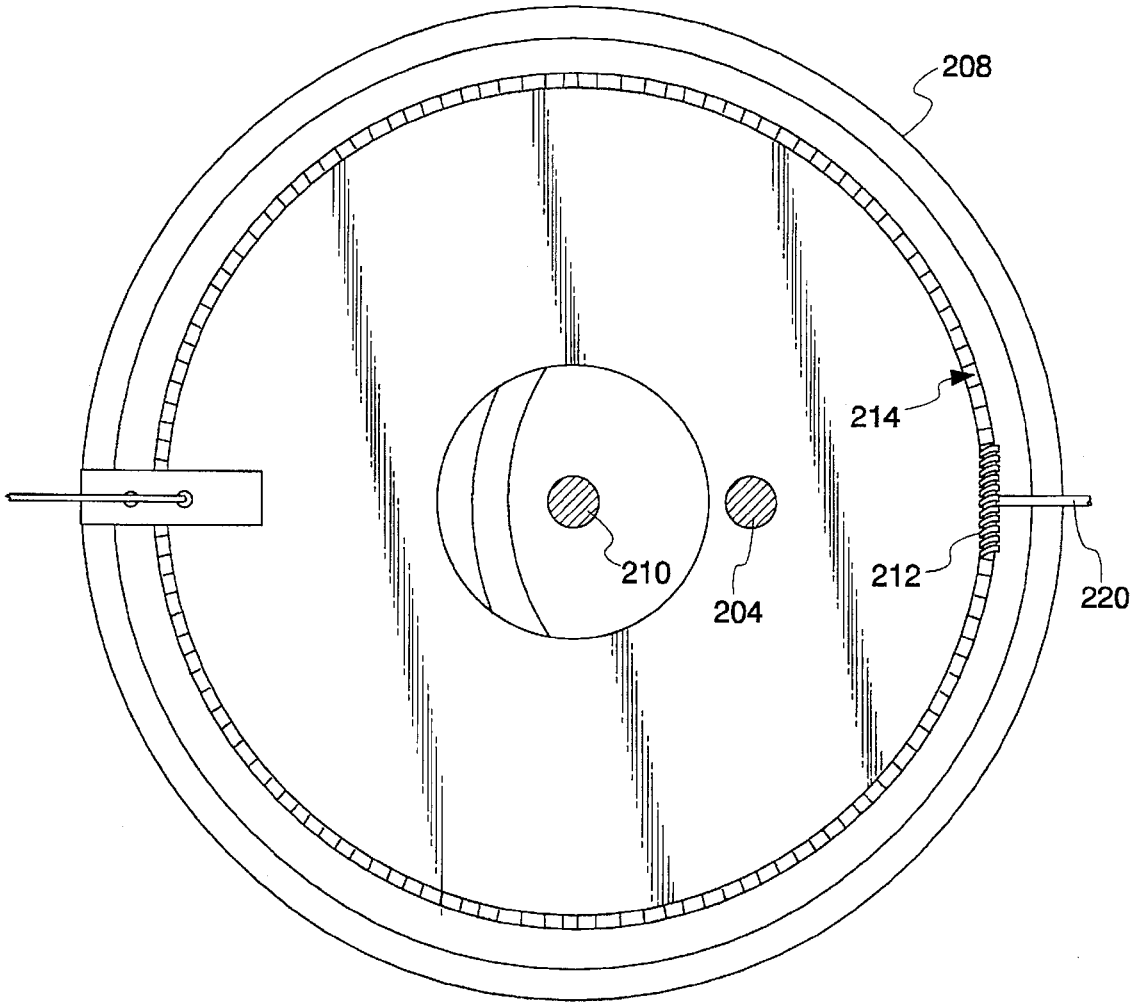
FIG. 11 is a fragmentary view taken along the line 11—11 of FIG. 10.

Turning now to FIGS. 10 and 11, an alternative arrangement of the dispensing apparatus is generally indicated at 200. The gripper arm 80 is suspended by a shaft 204 from coupling 104 of vacuum actuator 96. As in the preceding embodiment, actuator 96, through intervening members, raises and lowers gripper arm 80. However, in embodiment 200, the vacuum actuator 96 is carried on a support table 208 which is rotatably mounted on post 210. A drive gear 212 mates with a drive ring 214 located on the bottom surface 216 of table 208. Gear 212 is connected through a shaft 220 to a drive motor (not shown in the FIGURES) supported from support base 152. Gear 212 drives table 208 in a desired direction of rotation, causing the gripper arm to pass over valves 50, as described above. When a desired valve is selected by the control device, gripper arm 80 is positioned over the valve, as described above, and actuator 96 raises the gripper arm so as to operate the selected valve.

Figure 12:
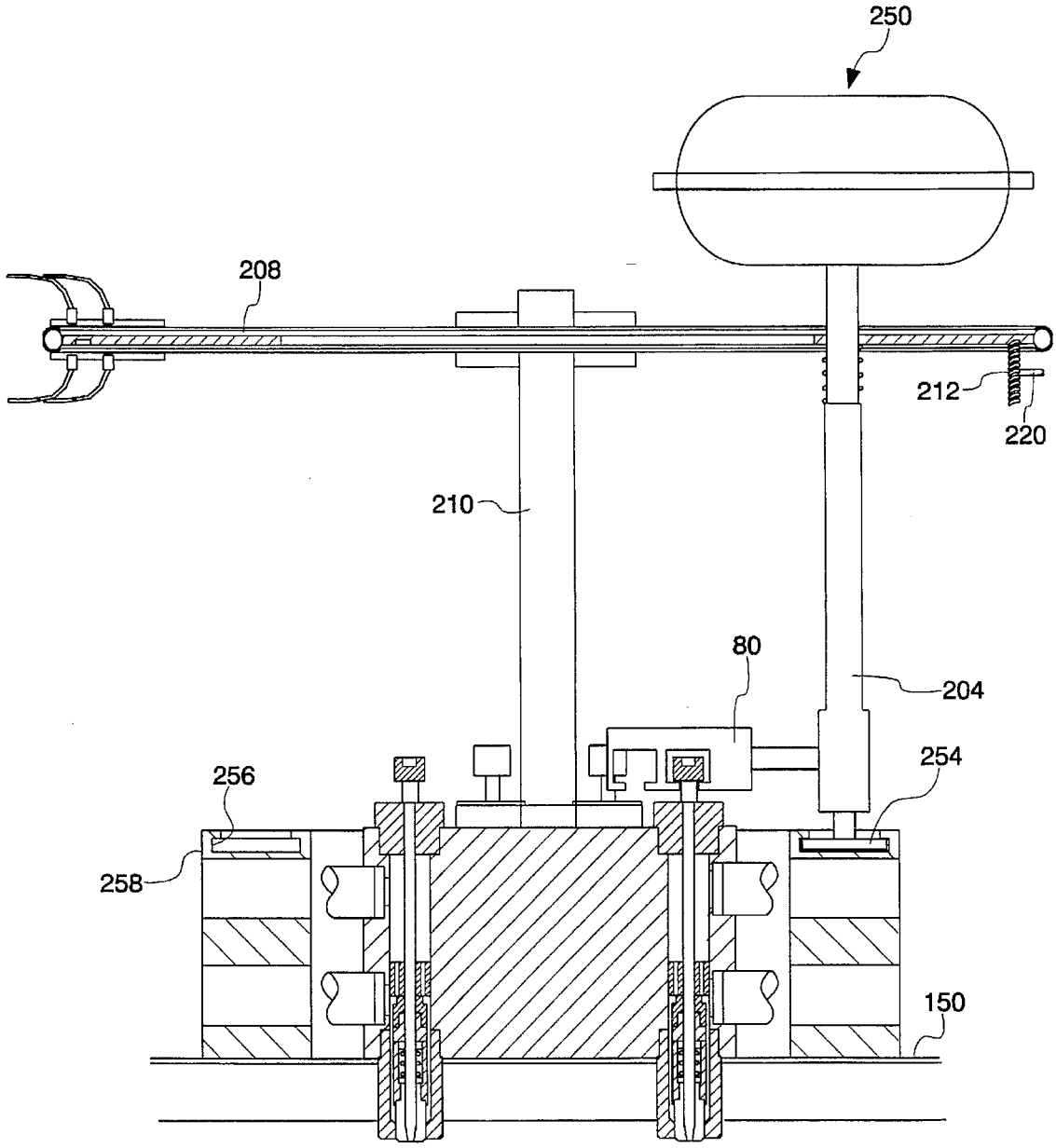
FIG. 12 is a cross-sectional view of another alternative embodiment of dispenser apparatus according to principles of the present invention.

Turning now to FIG. 12, an alternative dispensing arrangement is generally indicated at 250. In this embodiment, the shaft 204 is terminated at its bottom end with a shoe 254 received in the slot 256 formed in the upper end of a cylindrical track member 258. The gripper arm 80 is cantilevered from the lower end of shaft 204, at a point adjacent the track member. A support table 208 is rotatably driven by gear 212, as described above.

Figure 14:
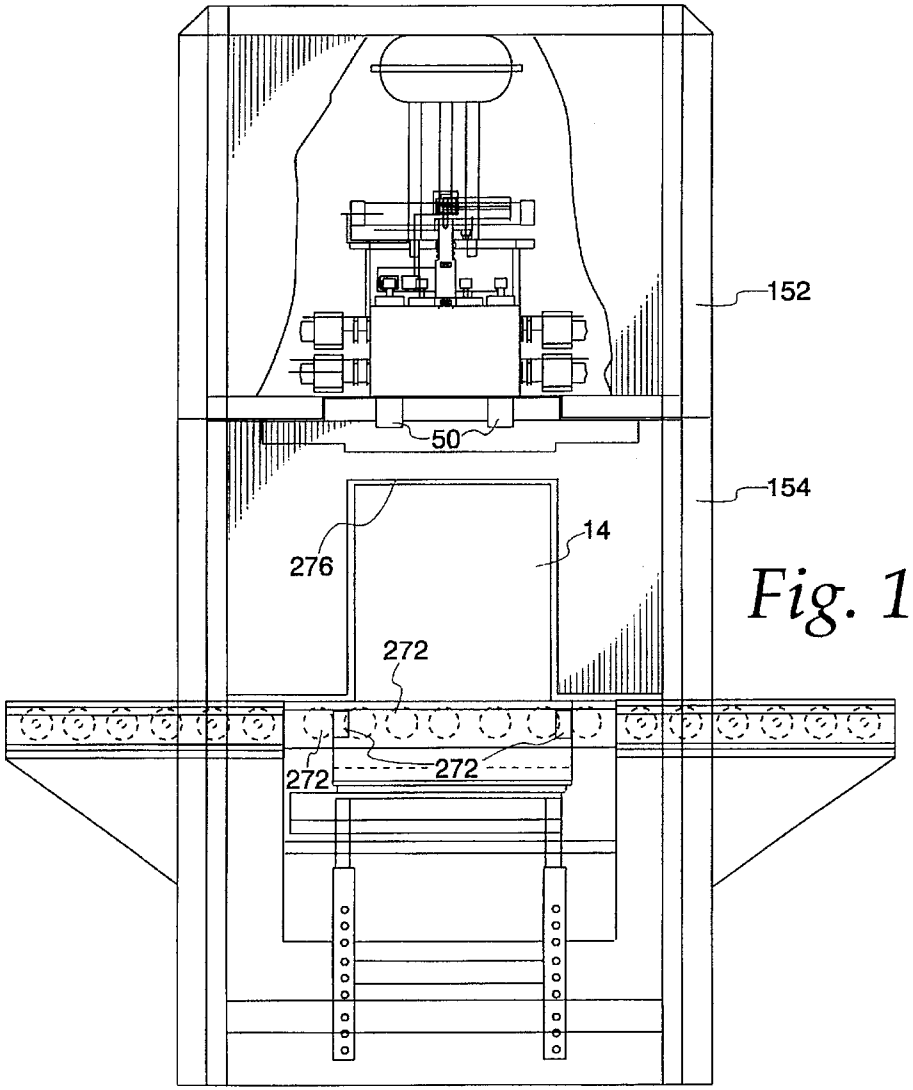
FIG. 14 is a front elevational view thereof.
Figure 13:
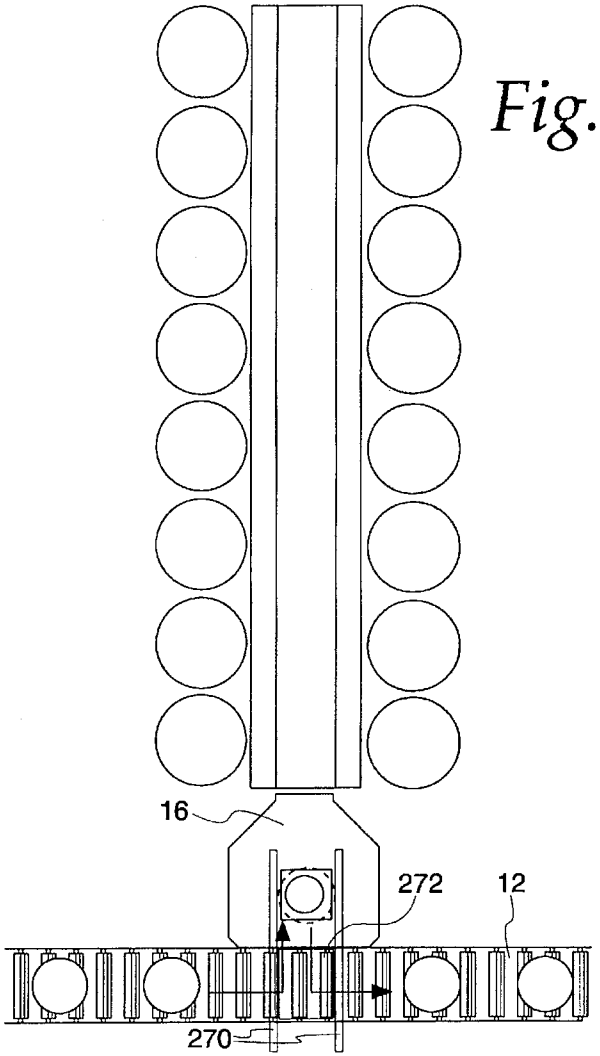
FIG. 13 is a top plan view of an alternative dispenser system according to principles of the present invention.

As described above in FIGS. 1–3, a conveyor 12 passes through housing 16, and an array of storage tanks 18. However, other conveyor arrangements are also possible. For example, turning to FIGS. 13 and 14, conveyor 12 passes across the front of dispense station 16. Shuttle tracks 270 guide a section 272 of conveyor 12 through an opening 276 formed in the lower cabinet member 154. A container 14 travels along conveyor 12, and is stopped on conveyor portion 272. The container is then shuttled underneath the dispense valves 50 in preparation for a dispensing operation. When dispensing is completed, the container 14 is then shuttled back to the position shown in FIG. 13, and travel is continued down conveyor 12. As shown in FIG. 14, conveyor 12 is mounted in a midportion of lower cabinet 154, being spaced above the floor.

Figure 16:
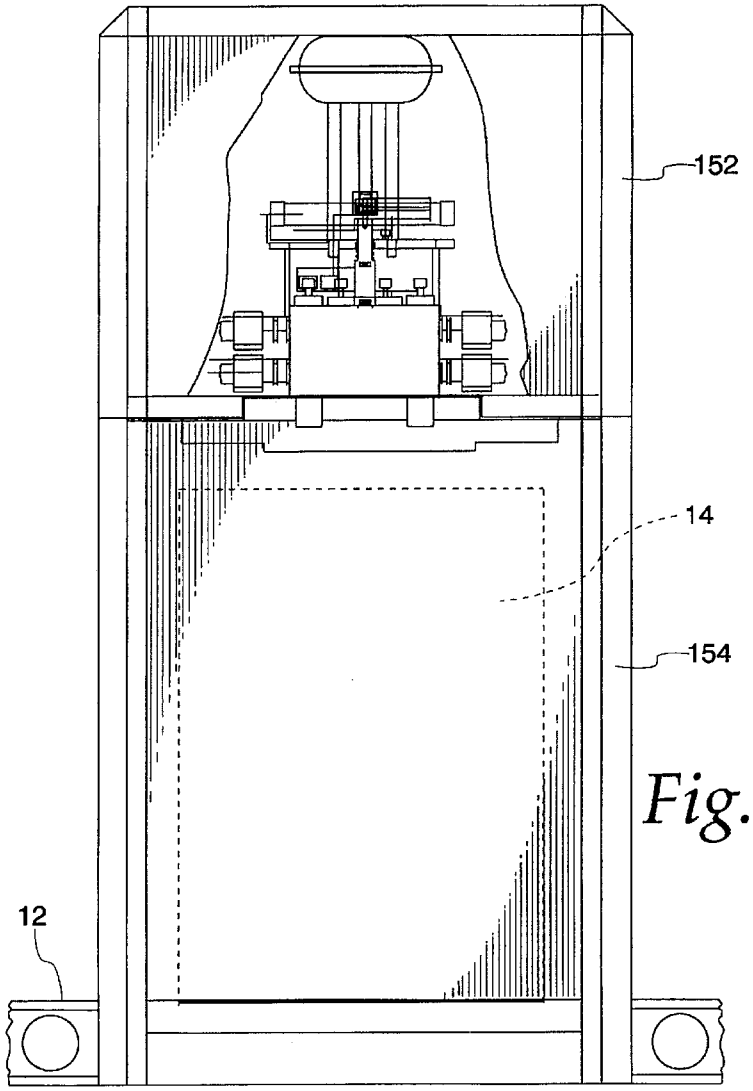
FIG. 16 is a front elevational view thereof.
Figure 15:
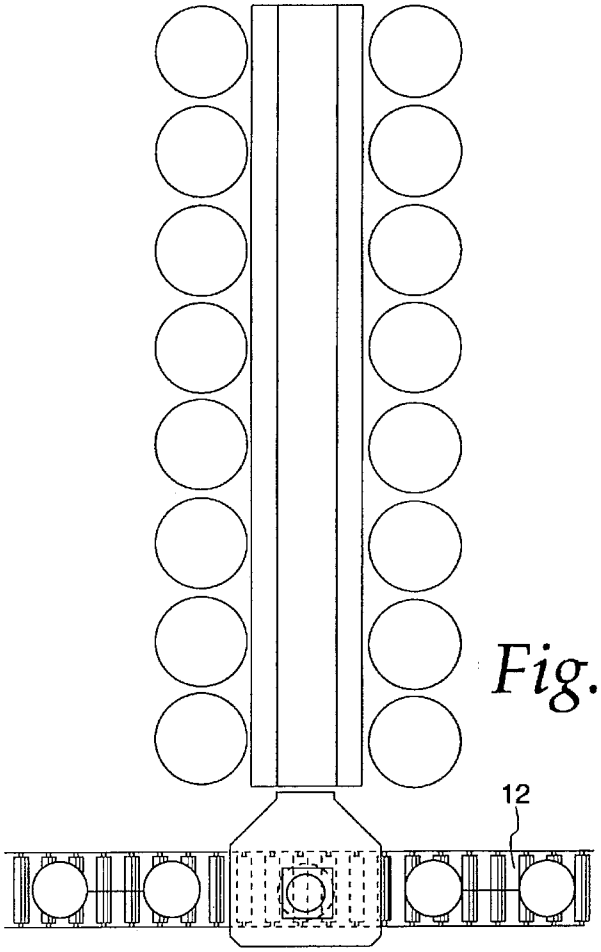
FIG. 15 is a top plan view of another alternative embodiment of a dispenser system according to principles of the present invention.

Turning now to FIGS. 15 and 16, conveyor 12 is located on the floor, so as to accommodate larger sized containers extending almost the full height of lower cabinet 154.

The dispense apparatus could also be readily adapted for valves arranged in three or more nested curved lines or line segments. For example, the dispense apparatus could have either three nested arcs or three concentric circles, with valves in each circle. The gripper arm for such arrangement would resemble the gripper arm 80, but would be longer if necessary and would have a third socket, aligned with the third circle.

If desired, the valves need not have coplanar enlarged ends. For example, the enlarged ends aligned along different concentric circles could be increasingly elevated in the outer circles. The enlarged ends would therefore lie along the surface of an imaginary, upwardly diverging, cone, with the gripper arm being upwardly inclined to match the angle of the imaginary cone, having downwardly opening sockets as shown in the FIGURES, above.

Further variations are also possible. For example, the valves need not be vertically operable, but could have actuators which move in inclined or even horizontal planes. The gripper arm and related drive assembly could be readily rotated from the horizontal reference plane shown and described above.

As can be seen from above, the dispense apparatus according to the present invention is flexible, being readily adapted to assume a number of different operating configurations, examples of which are discussed above.

Although one type of valve has been described above, it will be readily appreciated that the dispensing apparatus of the present invention can readily accommodate a wide variety of valves commercially available today. For example, valves having a single valve element can be employed.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Dispensing apparatus, comprising:

a plurality of valves arranged along multiple nested curved lines, the valves having housings with upper ends and coupling means at the upper ends for releasably engaging an arm, the coupling means operating the valves between open and closed positions when moved with respect to the valve housing;

an arm releasably engageable with the valve's coupling means; and mounting means for mounting the arm for movement across the valves, passing the arm into and out of engagement with the valves it crosses, and said mounting means mounting the arm for movement toward and away from the valves to open and close the valves so as to dispense material from the valves.

2. The apparatus of claim 1 wherein the arm defines two sockets for valves arranged along first and second nested curved lines, respectively.

3. The apparatus of claim 1 wherein the first and second nested curved lines comprise concentric circles, and the mounting means mounts the arm for rotation about the center of the concentric circles.

4. The apparatus of claim 3 wherein the plurality of valves have generally coplanar coupling means and the mounting means mounts the arm for rotation in a plane generally parallel to the coupling means.

5. The apparatus of claim 4 wherein the arm defines two sockets for valves arranged along the first and second concentric circles, respectively.

6. The apparatus of claim 5 wherein the sockets are downwardly opening, with the arm defining a relatively narrow opening below the socket.

7. Dispensing apparatus for dispensing a plurality of different materials, comprising:

a cabinet;

a plurality of valves arranged within the cabinet along first and second nested curved lines, the valves having housings with upper ends and coupling means at the upper ends for releasably engaging an arm, the coupling means operating the valves between open and closed positions when moved with respect to the valve housing;

conduit means extending outside the cabinet from the valves, for carrying materials to the valves from materials sources located outside the cabinet;

the cabinet including container supporting means for supporting a container underneath the valves, to receive material dispensed from the valves;

an arm releasably engageable with the valve's coupling means; and mounting means for mounting the arm for movement across the valves, passing the arm into and out of engagement with the valves it crosses, and said mounting means mounting the arm for movement toward and away from the valves to open and close the valves so as to dispense material from the valves.

8. The apparatus of claim 7 wherein the arm defines two sockets for valves arranged along first and second nested curved lines, respectively.

9. The apparatus of claim 7 wherein the first and second nested curved lines comprise concentric circles, and the mounting means mounts the arm for rotation about the center of the concentric circles.

10. The apparatus of claim 9 wherein the plurality of valves have generally coplanar coupling means and the mounting means mounts the arm for rotation in a plane generally parallel to the coupling means.

11. The apparatus of claim 10 wherein the arm defines two sockets for valves arranged along the first and second concentric circles, respectively.

12. The apparatus of claim 11 wherein the sockets are downwardly opening, with the arm defining a relatively narrow opening below the socket.

13. Dispensing system for dispensing a plurality of different materials, comprising:

a dispense cabinet;

a plurality of storage tanks outside of the dispense cabinet containing at least some of the materials to be dispensed;

a plurality of valves arranged within the cabinet along first and second nested curved lines, the valves having housings with upper ends and coupling means at the upper ends for releasably engaging an arm, the coupling means operating the valves between open and closed positions when moved with respect to the valve housing;

conduit means coupling the tanks to the valves;

plurality of pumps for pumping the materials to the valves;

the cabinet including container supporting means for supporting a container underneath the valves, to receive material dispensed from the valves;

an arm releasably engageable with the valve's coupling means; and mounting means for mounting the arm for movement across the valves, passing the arm into and out of engagement with the valves it crosses, and said mounting means mounting the arm for movement toward and away from the valves to open and close the valves so as to dispense material from the valves.

14. The apparatus of claim 13 wherein the arm defines two sockets for valves arranged along first and second nested curved lines, respectively.

15. The apparatus of claim 13 wherein the first and second nested curved lines comprise concentric circles, and the mounting means mounts the arm for rotation about the center of the concentric circles.

16. The apparatus of claim 15 wherein the plurality of valves have generally coplanar coupling means and the mounting means mounts the arm for rotation in a plane generally parallel to the coupling means.

17. The apparatus of claim 16 wherein the arm defines two sockets for valves arranged along the first and second concentric circles, respectively.

18. The apparatus of claim 17 wherein the sockets are downwardly opening, with the arm defining a relatively narrow opening below the socket.

19. Dispensing apparatus, comprising:

a plurality of valves arranged along first and second concentric circles, the valves having housings with upper ends and coupling means at the upper ends for releasably engaging an arm, the coupling means operating the valves between open and closed positions when moved with respect to the valve housing;

an arm releasably engageable with the valve's coupling means; and mounting means for mounting the arm for rotation about the center of the concentric circles, across the valves, passing the arm into and out of engagement with the valves it crosses, and said mounting means mounting the arm for movement toward and away from the valves to open and close the valves so as to dispense material from the valves.

20. The apparatus of claim 19 wherein the arm defines two sockets for valves arranged along the first and second concentric circles, respectively.

21. The apparatus of claim 19 wherein the plurality of valves have generally coplanar coupling means and the mounting means mounts the arm for rotation in a plane generally parallel to the coupling means.

22. The apparatus of claim 21 wherein the arm defines two sockets for valves arranged along the first and second concentric circles, respectively.

23. The apparatus of claim 22 wherein the sockets are downwardly opening, with the arm defining a relatively narrow opening below the socket.

* * * * *